United States Patent [19]

Gilbert

[11] Patent Number: 4,795,390

[45] Date of Patent: Jan. 3, 1989

[54] METHOD OF MANUFACTURING A PHOTOMULTIPLIER TUBE HAVING A PROXIMITY MULTIPLIER ELEMENT

[75] Inventor: Eschard Gilbert, Brive la Gaillarde, France

[73] Assignee: U.S. Philips Corp., New York, N.Y.

[21] Appl. No.: 87,066

[22] Filed: Aug. 14, 1987

Related U.S. Application Data

[63] Continuation of Ser. No. 932,057, Nov. 18, 1986, abandoned.

[30] Foreign Application Priority Data

Jun. 3, 1986 [FR] France ..... 86 07967

[51] Int. Cl.[4] ..... H01J 9/18

[52] U.S. Cl. ..... 445/29; 445/14; 445/33; 445/38

[58] Field of Search ..... 445/29, 33, 38, 14, 445/10

[56] References Cited

U.S. PATENT DOCUMENTS

| | | | |
|---|---|---|---|
| 2,975,015 | 3/1961 | Davis | 445/33 |
| 3,026,163 | 3/1962 | Day | 445/29 |
| 3,590,304 | 6/1971 | Moegenbier | 445/29 |
| 4,094,563 | 6/1978 | Simms | 445/38 |
| 4,671,778 | 6/1987 | Musselman | 445/14 |

*Primary Examiner*—Kurt Rowan

*Attorney, Agent, or Firm*—William L. Botjer

[57] ABSTRACT

A method of manufacturing a photomultiplier tube (10) comprising a tube body (20), a photocathode (30) and an electron multiplier element (40) destined to be placed at a small distance from the photocathode (30). According to the invention the tube (10) is provided with sliding means (50) of the electron multiplier (40) parallel to the axis (22) of the tube body (20), means (50) provided with abutments (53) situated in the proximity of the said window (31). The electron multiplier (40) is also provided with means (60) for the remote soldering of the electron multiplier to the said sliding means (50), and in a first step the electron multiplier (40) is placed at a sufficient distance from the window (31), then in a second step the constituents of the photocathode are evaporated by means of evaporators (70) placed at a distance from the window and, in a third step, the electron multiplier (40) is moved against the said abutments (53), while in a fourth step the electron multiplier (40) is maintained in position in the proximity of the photocathode (30) by remote soldering to the sliding means (50) with the aid of the remote soldering means (60).

7 Claims, 1 Drawing Sheet

METHOD OF MANUFACTURING A PHOTOMULTIPLIER TUBE HAVING A PROXIMITY MULTIPLIER ELEMENT

This is a continuation of application Ser. No. 932,057, filed Nov. 18, 1986, abandoned.

BACKGROUND OF THE INVENTION

The present invention relates to a method of manufacturing a photomultiplier tube having a proximity multiplier element.

The essential problem to be solved by any method of manufacturing a photomultiplier tube having a proximity multiplier element, a flat photomultiplier having sheet multipliers or a display tube having a disc of microchannels consists in evaporating the photocathode while in such a tube the distance between the photocathode and the multiplier element, sheet multiplier or microchannel disc is very small, on the order of 0.2 mm. It is known from the technique of manufacturing photomultiplier tubes that a good evaporation leading to homogeneous photocathode requires a photocathode-multiplier distance at least on the order of the diameter of the photocathode.

In order to solve said difficulty it is known, for example, from U.S. Pat. No. 3,026,163, to place the window of the photocathode on the one hand and the body of the tube on the other hand in compartments which are separated but communicate with each other and which are then exhausted. The photocathode is then deposited on the window, then activated, in its compartment and transferred by sliding into the other compartment where it is assembled to the body of the tube and where the sealing takes place It will be obvious that such a method is extremely laborious and expensive, since in practice only one tube can be treated at a time in the manufacturing apparatus. Moreover, said process requires the constant attention of highly qualified and skilful operators.

SUMMARY OF THE INVENTION

The object of the present invention is to provide a method of manufacturing a tube comprising a body of a tube, a photocathode deposited on a window is sealed at a first extremity of the body of the tube, and an electron multiplier element placed at a small distance from the photocathode. By the method a photocathode can be realized of high quality in the interior of the exhausted and sealed tube in spite of the presence in the said tube of the electron multiplier element.

According to the invention, the solution of this general technical problem consists in that the tube is provided with sliding means of the electron multiplier parallel to the axis of the body of the tube. The said sliding means is formed integral with the tube and comprises abutting means situated in the proximity of the said window. The electron multiplier is provided with means for the remote soldering of the electron multiplier to the said sliding means. In a first step the tube is sealed and exhausted and the electron multiplier is placed at a distance from the window of the order of the diameter of the said window. In a second step the constituents of the photocathode are evaporated by means of evaporators placed at a distance from the window. In a third step the electron multiplier is moved by sliding along the sliding means against the said abutting means. In a fourth step the electron multiplier is maintained in position in the proximity of the photocathode by remote soldering to the sliding with the aid of remote soldering means.

The transfer in situ of the electron multiplier element in a position remote from a position near the photocathode thus permits of avoiding the evaporation of the photocathode outside the body of the tube, then the transport of the photocathode for sealing on the body of the tube. The method according to the present application thus leads to a considerable decrease of the cost price of the photomultiplier tubes having proximity multiplier elements thus manufactured.

BRIEF DESCRIPTION OF THE DRAWING

From the following description with reference to the accompanying drawings, given by way of non-limiting example, it will be well understood of what the invention consists and how it can be realized.

DESCRIPTION OF THE PREFERRED EMBODIMENTS

Figure 1:
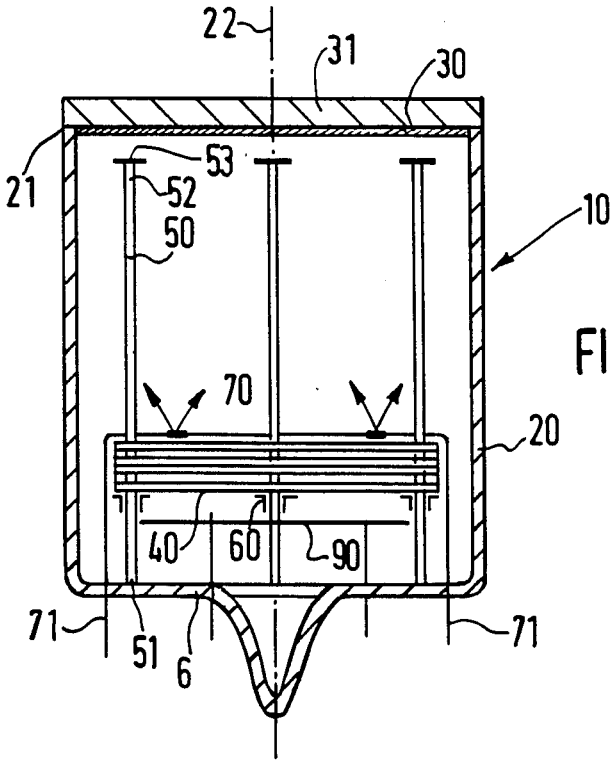
FIG. 1 is a sectional view of a photomultiplier tube having a proximity multiplier element during a first phase of its manufacture by the method according to the invention.

The sectional view of FIG. 1 shows a first phase of a method of manufacturing a photomultiplier tube 10 having a proximity multiplier element. Said tube 10 comprises notably a tube body 20, a photocathode 30 deposited on a window 31 sealed at a first extremity 21 of the body 20 of the tube and an electron multiplier 40 which must be placed at a small distance (of the order of 0.2 mm) from the photocathode 30 so as to realize the proximity focusing. In the example shown in FIGS. 1 and 2 the electron multiplier 40 is a multiplier of the type "with sheets".

The tube 10 is provided with sliding means 50 of the electron multiplier 40 parallel to the axis 22 of the tube body 20, said sliding means being realized, for example, by means of 3 rods 50 formed integral with the tube 10 by soldering their extremities 51 to the base 6 of the tube, the rods 50 traversing the electron multiplier 40 through passages provided at its periphery. At their extremities 52 the rods 50 comprise abutting means 53 situated in the proximity of the window 31 and which in the example described in FIGS. 1 and 2 have the form of nail heads. Moreover, the electron multiplier 40 is provided with means 60 for the remote soldering of the said electron multiplier to the sliding rods 50. In the case shown in FIGS. 1 and 2 said remote soldering means have the form of metallic eyelets which can be fused by the radiation of a laser.

In a first step the tube 10 is first exhausted and then sealed and the electron multiplier 40 is placed at a distance from the window 31 of the order of the diameter of the said window. This configuration is that shown in FIG. 1. In a second step the constituents of the photocathode are evaporated by means of evaporators 70 placed at a distance from the window 31, for example, on the circumference of the multiplier element 40. As shown in FIG. 1, the evaporators 70 are in the form of grains (antimony, cesium, etc.) provided on conductive wires 71 which emerge outside the tube and through which an electric current is passed so as to evaporate the grains 70. Taking into account the comparatively large distance between the evaporators 70 and the window 31, the photocathode 30 thus manufactured has a good homogeneity.

Figure 2:
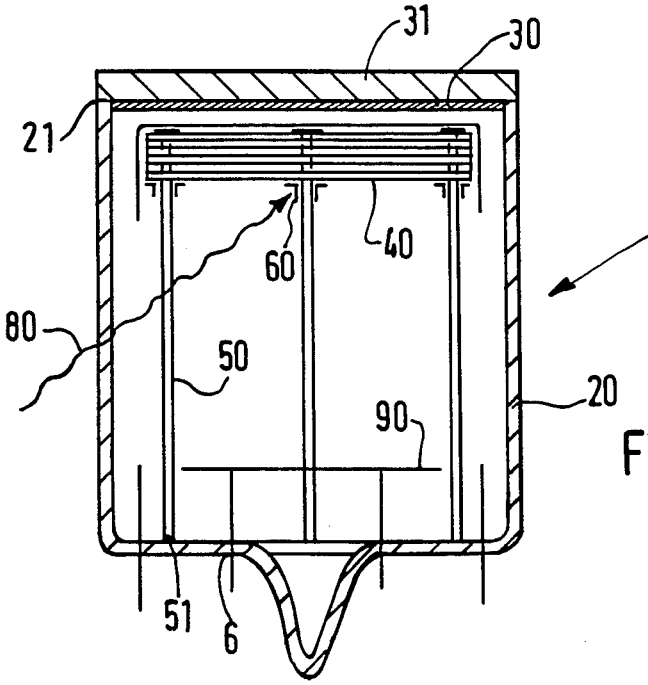
FIG. 2 is a sectional view of the FIG. 1 tube at the end of its manufacture by the method according to the invention.

In a third step the electron multiplier 4 is moved in the position shown in FIG. 2, by sliding under the effect of for example, gravity, along rods 50 and against the abutting means 53. The conductive wires 71 serving for the evaporation of the photocathode have previously been severed by remote control by means of, for example, a laser beam.

Finally in a fourth step, the electron multiplier 40 is maintained in a position in the proximity of the photocathode 30 by the remote soldering of fusible metallic eyelets 60 to the rods 50 by means of a laser beam 80.

As shown in FIGS. 1 and 2, the tube 10 comprises an anode 90 which, in the case of a flat photomultiplier tube with sheet multipliers, may be divided into independent sub-anodes so as to constitute a multi-anode and a tube segmented into several secondary tubes.

What is claimed is:

1. A method of manufacturing a photomultiplier tube (10) having a proximity multiplier element, the said tube comprising a tube body (20), a photocathode (30) deposited on a window (31) sealed at a first extremity (21) of the tube body, and an electron multiplier element (40) placed at a small distance from the photocathode (30), characterized in that the tube (10) is provided with sliding means (50) of the electron multiplier (40) parallel to the axis (22) of the tube body (20), the said sliding means (50) being formed integral with the tube (10) and comprising abutting means (53) situated in the proximity of the said window (31) and in that the electron multiplier (40) is provided with means (60) for the remote soldering of the electron multiplier to the said sliding means (50), and in that in a first step the tube (10) is sealed and exhausted and the electron multiplier (40) is placed at a distance from the window (31) of the order of the diameter of the said window, and in that in a second step the constituents of the photocathode are evaporated by means of evaporators (70) placed at a distance from the window and that in a third step the electron multiplier is moved by sliding along the sliding means (50) against the said abutting means (53), while in a fourth step the electron multiplier (40) is maintained in position in the proximity of the photocathode (30) by remote soldering to the sliding means (50) with the aid of remote soldering means (60).

2. A method as claimed in claim 1, characterized in that the said sliding means (50) are rods which are soldered at one (51) of their extremities to the base (6) of the tube (10) and comprise the abutting means (53) at their other extremities (52).

3. A method as claimed in any of the claims 1 and 2, characterized in that the said remote soldering means (60) are metallic eyelets which can be fused under the effect of a laser beam.

4. A method of manufacturing a photomultiplier tube, said method comprising the steps of:

exhausting and sealing a tube containing an electron multiplier and an evaporator, said tube having a window with an inner surface and a diameter;

spacing the electron multiplier from the window a distance on the order of the diameter of the window;

spacing the evaporator from the window;

evaporating a photocathode onto the inner surface of the window;

moving the electron multiplier into a position in the proximity of the photocathode; and affixing the electron multiplier into the position in the proximity of the photocathode.

5. A method as claimed in claim 4, characterized in that:

the tube contains sliding means fixed to the tube, said sliding means having an abutment in the proximity of the window; and the step of moving the electron multiplier comprises sliding the electron multiplier on the sliding means until the electron multiplier contacts the abutment.

6. A method as claimed in claim 5, characterized in that the sliding means comprises rods having first and second opposite ends, the first ends being affixed to the tube, the second ends having abutments.

7. A method as claimed in claim 5, characterized in that the electron multiplier is affixed at the position in the proximity of the photocathode by soldering with a laser beam.

* * * * *